US006832404B2

(12) United States Patent
Hwang

(10) Patent No.: US 6,832,404 B2
(45) Date of Patent: Dec. 21, 2004

(54) CLEANING MACHINE FOR SHIRT COLLAR

(76) Inventor: Yong Koo Hwang, 3669 Middlefield Rd., Palo Alto, CA (US) 94303

( * ) Notice: Subject to any disclaimer, the term of this patent is extended or adjusted under 35 U.S.C. 154(b) by 169 days.

(21) Appl. No.: 10/360,710

(22) Filed: Feb. 8, 2003

(65) Prior Publication Data

US 2004/0154355 A1 Aug. 12, 2004

(51) Int. Cl.[7] ..... B08B 1/04

(52) U.S. Cl. ..... 15/40; 15/21.1; 134/165; 134/137; 68/200

(58) Field of Search ..... 15/21.1, 77, 40; 134/137, 151, 165, 201; 68/200, 5 B, 220

(56) References Cited

U.S. PATENT DOCUMENTS 1,796,504 A * 3/1931 Burrows ..... 65/87
4,123,547 A * 10/1978 Christensen et al. ..... 514/210.1
5,255,541 A * 10/1993 Porter et al. ..... 68/205 R
2002/0134117 A1 * 9/2002 Arai et al. ..... 68/3 SS

FOREIGN PATENT DOCUMENTS

JP 2-5996 * 1/1990
JP 2-13497 * 1/1990
JP 2000-210492 * 8/2001

* cited by examiner

*Primary Examiner*—Frankie L. Stinson

(57) ABSTRACT

A collar cleaning system for dress shirts comprising a slide plate, a guiding plate, a pressured soap-water spraying subsystem and a rotating brush is presented. The shirt collar is loaded onto the sliding plate and moved under the rotating brush while being sprayed with soap water to remove the dirt ring around the collar.

1 Claim, 2 Drawing Sheets

CLEANING MACHINE FOR SHIRT COLLAR

BACKGROUND OF THE INVENTION

Cleaning of dress shirts is one of the major tasks in laundry business. Dress shirts get dirty at the collar even after just one day of wearing. The rings around the collar remain even after being washed in a conventional washing machine, and thus dry cleaners brush the collar with soap water before putting in the washing machine. Manual brushing of the collar over several hours causes fatigue in the arms and hands, and it is the object of this invention to automate the brushing operation of dress shirts.

There are many machines for dry cleaning and laundry, but there is no shirt-collar cleaning machine similar to this invention.

BRIEF SUMMARY OF THE INVENTION

Accordingly, it is the object of this invention to offer a shirt-collar cleaning system that alleviates tiring manual brushing operation. The collar cleaning system is comprised of a rotating brush, a plate assembly, water pump and valve assembly, and a soap-water tank. Upon power up, the water pump transfers soap water from the soap-water tank into a chamber in which an appropriate pressure range is maintained. The rotating brush spins just above the sliding plate assembly. The plate assembly is comprised of an elongated stationary guiding plate and an elongated sliding plate that moves sideways on the guiding plate. The user of this system places the shirt collar on the sliding plate, and moves the plate sideways with the collar under the brush to remove the ring along the collar. A push switch placed in the guiding plate directly under the brush so that soap water is sprayed onto the collar as the sliding plate activates the switch as it starts to pass under the brush. As long as a portion of the sliding plate is under the brush, it activates the switch and soap water is sprayed onto the collar. Alternatively, a remote controlled switch located on the sliding plate can activate the spraying action.

BRIEF DESCRIPTION OF THE SEVERAL VIEWS OF THE DRAWING

These and other features, aspects and advantages of the present invention will become better understood with reference to the accompanying drawings, wherein.

DETAILED DESCRIPTION OF THE INVENTION

Figure 1:
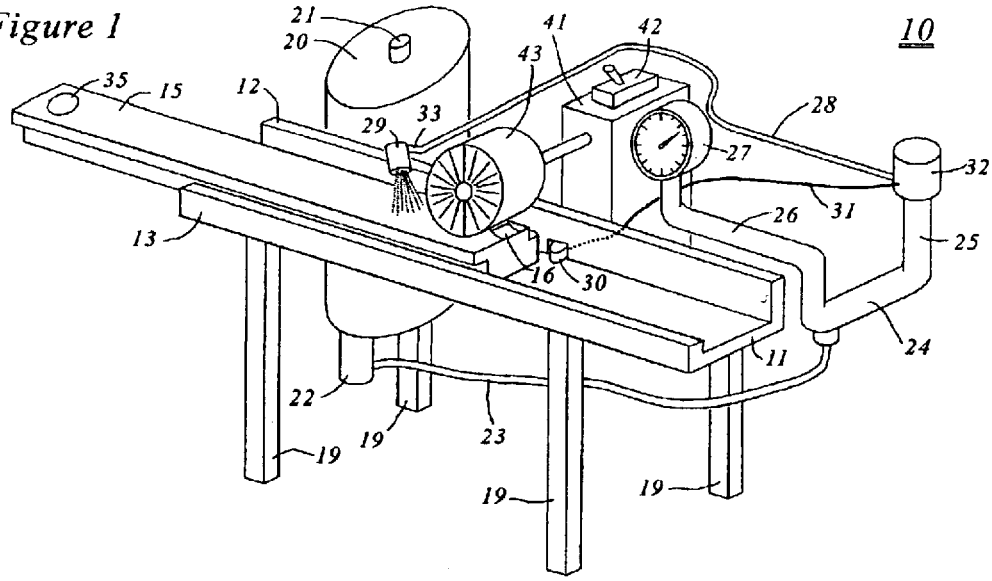
FIG. 1 is a perspective view of the collar cleaning system according to the present invention.
Figure 2:
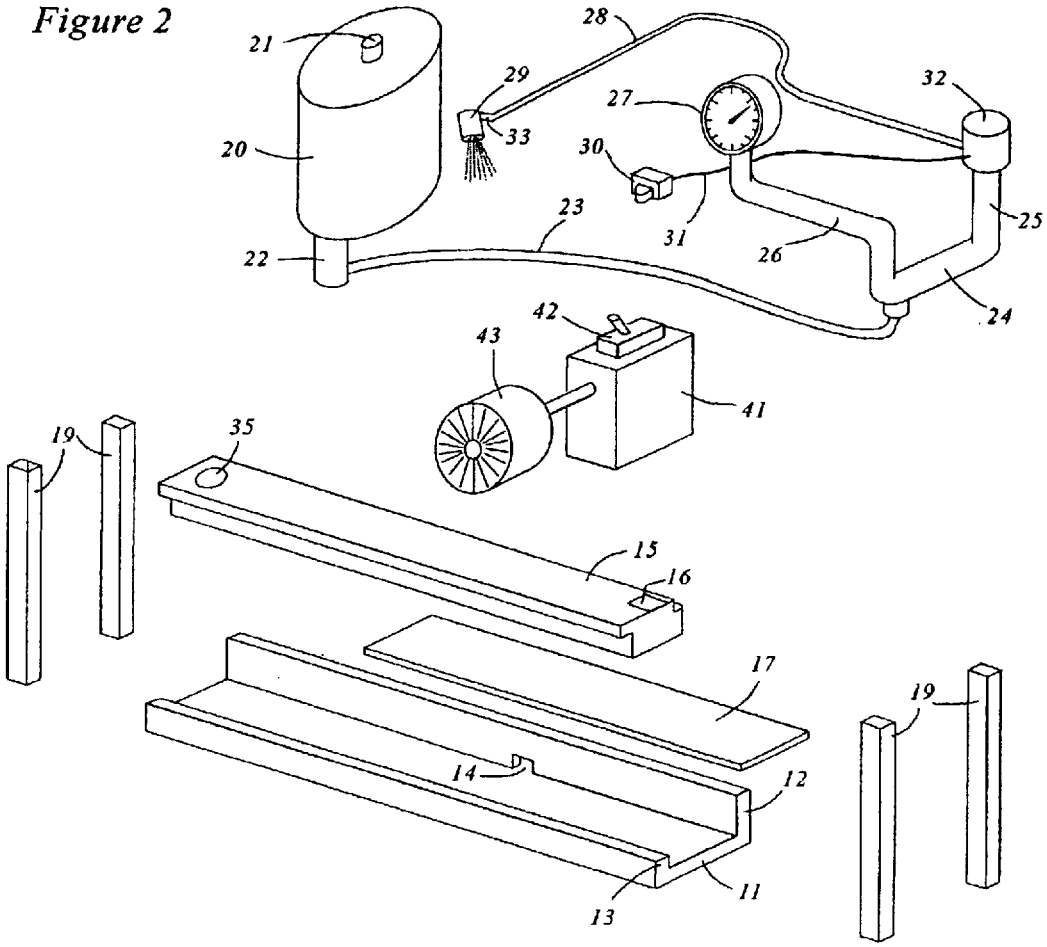
FIG. 2 is a perspective exploded view of the collar cleaning system of the present invention.
Figure 3:
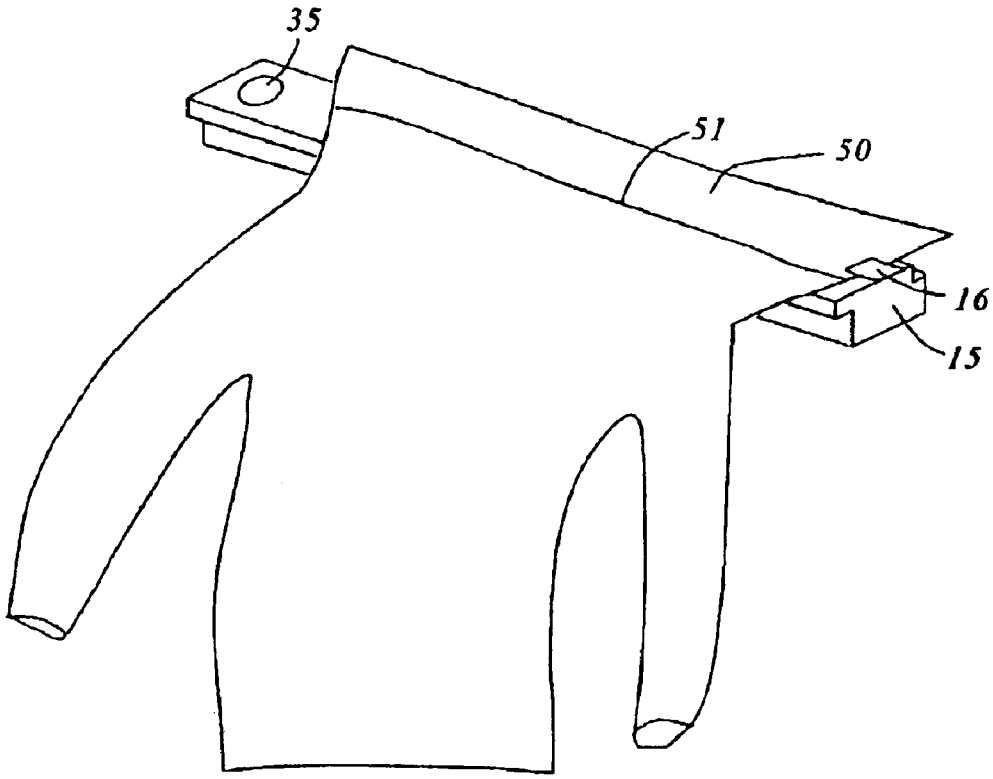
FIG. 3 is the view of the sliding plate with a shirt collar clipped on it.

With the reference to the accompanying drawings, the present invention will now be described. As shown in FIGS. 1–3, the present invention is provided as a shirt collar cleaning system 10 comprising an elongated sliding plate assembly 11, 12, 13, 15 on which the collar of a shirt is placed. The collar cleaning system further has a motor 41 and brush 43 assembly, and a soap water spraying assembly 20–32 consisting of a water tank 20, a water pump 22, a pressurized chamber 24–26, a pressure gauge 27, a switched valve 30–33, a spraying nozzle 29, and connecting hoses 23, 28. The valve switch 30 protrudes through a small hole 14 in the guiding plate wall 12 so that pushing the sliding plate 15 against the switch 30 can activate the valve 32. In place of the push switch 30, a remote controlled switch 35 can be used to control the soap-water valve 32. The part 33 of the hose 28 connected to the nozzle side is inclined as it nears the nozzle 29 to prevent the drainage of the soap water in the hose 28 when the valve 32 is closed. Four legs 19 are attached to support the cleaning system at the bottom of the guiding plate 11–13 and the hind support board 17. The motor assembly 41–43 and the pressurized chamber 24–26 are attached on top of the hind support board 17, while the water tank 20 is attached to the side of the hind support board 17.

The operation of the collar cleaning system is as follows. Upon power up, the water pump 22 pumps soap water into the pressurized chamber consisting of tubes 24–26, wherein the air trapped in the tubes provides pressure. The user then turns on the motor switch 42, causing the brush 43 to rotate. The user then loads a shirt collar 50 onto the sliding plate 15 by inserting the right-side end of the collar into a clip 17 attached at the top of the sliding plate 15. The dirt ring 51 around the collar is now placed along the middle of the sliding plate 15. The user then holds the ensemble of the collar 50 and the sliding plate 15 and slides it to the right while pushing the valve switch 30 with the sliding plate 15. This opens the valve 32 that in turn causes the soap water to be sprayed onto the collar 50 through the nozzle 29. When the rotating brush 43 scrubs the whole length of the collar 50 and removes the dirt ring 51, the user can let go of the sliding plate 15 and unload the shirt collar 50. The valve switch 30 is spring loaded so that the valve 32 is shut as soon as the user let go of the sliding plate 15.

The advantage of the collar cleaning system 10 is the automation of the shirt-collar brushing action so as to minimize the fatigue of laundry workers. This greatly increases the efficiency of the shirt cleaning process. Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A shirt-collar cleaning system comprising;

an elongated sliding plate and a guiding plate;

a sliding plate further comprising with a clip to hold the collar;

a sliding plate further comprising a remote switch to activate the soap-water valve;

a guiding plate further comprising a spring-loaded switch to activate a soap-water valve;

a rotating brush situated just above the sliding plate;

a soap-water spraying system comprising a tank, a pump, a pressure chamber, a pressure gauge, a valve, a spray nozzle and connecting hoses;

a pressure chamber further comprising entirely with the tubing to connect the pressure gauge and the valve without any extra tank;

the last part of the hose connected to the spray nozzle that is inclined as it nears the nozzle to prevent drainage of the soap water in the hose when the valve is closed.

* * * * *